United States Patent [19]

Rundzaitis

[11] Patent Number: 4,657,185

[45] Date of Patent: Apr. 14, 1987

[54] SHOWERHEAD

[75] Inventor: Alfons Rundzaitis, Beverly Shores, Ind.

[73] Assignee: Associated Mills, Inc., Chicago, Ill.

[21] Appl. No.: 729,274

[22] Filed: May 1, 1985

[51] Int. Cl.[4] ..... B05B 1/32

[52] U.S. Cl. ..... 239/438; 239/443; 239/460

[58] Field of Search ..... 239/436–438, 239/443, 439–441, 444, 446–449, 456–458, 460

[56] References Cited

U.S. PATENT DOCUMENTS

| | | | |
|---|---|---|---|
| 2,888,210 | 5/1959 | McLean | 239/439 |
| 2,990,122 | 6/1961 | Blumberg et al. | 239/440 X |
| 3,286,935 | 11/1966 | Corlett et al. | 239/440 X |
| 3,384,307 | 5/1968 | Moen | 239/458 X |
| 3,403,860 | 10/1968 | Shames et al. | 239/460 |
| 3,596,835 | 8/1971 | Smith et al. | 239/394 |
| 3,998,390 | 12/1976 | Peterson et al. | 239/394 |
| 4,346,844 | 8/1982 | Harmony | 239/460 X |

FOREIGN PATENT DOCUMENTS

| | | | |
|---|---|---|---|
| 2056552 | 12/1978 | Fed. Rep. of Germany | 239/438 |
| 180911 | 11/1935 | Switzerland | 239/449 |

OTHER PUBLICATIONS

*The Sharper Image Catalog,* Apr. 1985, "Shower Massager with Steam Bath", p. 40.

*Primary Examiner*—Andres Kashnikow
*Assistant Examiner*—Daniel R. Edelbrock
*Attorney, Agent, or Firm*—Allegretti, Newitt, Witcoff & McAndrews, Ltd.

[57] ABSTRACT

An improved showerhead comprising a nozzle and a ring valve. The interior of the nozzle defines a secondary fluid passageway. The exterior of the nozzle includes a plurality of grooves on the front portion of the nozzle. The nozzle also includes at least one opening through its sidewall. The ring valve includes a recessed cavity and fits over the nozzle in sliding engagement with the nozzle between a first and second position. When the ring valve is in its first position, the recessed cavity communicates with both the opening and the channel passageways to form a primary fluid passageway, permitting water to flow through both the primary and the secondary fluid passageways. When the ring valve is in its second position, the inner surface of the ring valve blocks the opening through the nozzle sidewall such that fluid flows through only the secondary fluid passageways rather than the primary channel passageways. In preferred form, the front end of the nozzle wall flares outward in divergent frustoconical fashion such that fluid flow through the nozzle creates a pressure drop which atomizes fluid flowing the secondary passageway into a steam-like mist.

11 Claims, 5 Drawing Figures

SHOWERHEAD

BACKGROUND OF THE INVENTION

The present invention relates to an improved showerhead for use in a bathroom shower and the like. More particularly, the improved showerhead of this invention permits the user to select either a normal spray or a steam-like mist spray to discharge the water.

In the past, a variety of different types of wall mounted and hand-held showerheads have been known. Generally, the showerhead heretofore available for use has included only a single nozzle, although such a spray nozzle often included a plurality of apertures or water discharging orifices. Some such prior showerheads have provided a "pulsating" discharge. Other liquid spraying showerheads have included a plurality of such spray nozzles or orifices and have been designed so as to permit a selection of a particular spray nozzle or orifice through which liquid is to be discharged. Peterson and Rundzaitis, U.S. Pat. No. 3,998,390 and Smith, U.S. Pat. No. 3,596,835, disclose liquid spraying nozzles of this general type.

While these prior showerheads have performed admirably and provide significant advantages over their prior art, these prior devices have had some disadvantages. Generally, these devices have been unable to provide a steam-like mist that converts a shower into a sauna, although they have provided a variety of other spray effects. Moreover, the prior showerheads tended to be relatively bulky and cumbersome. This, of course, limits the utility and the purchaser acceptance of these devices.

SUMMARY OF THE INVENTION

It is a primary object of the present invention to provide an improved showerhead which enables the user to select either a conventional spray water output, or a steam-like mist output.

Another object of the present invention is to provide an improved showerhead which has a relatively simple design and may be inexpensively manufactured.

Yet still a further object of the present invention is to provide an improved showerhead of the type described having a smaller, more streamlined and compact design.

More specifically, the improved showerhead of our invention comprises a nozzle having a first substantially cylindrical wall member. This first substantially cylindrical wall member has a front end, a back end, a longitudinal axis, and an interior cavity. The back end of the nozzle is adapted for connection to internal household plumbing or any ordinary water source. The front end of the nozzle defines an orifice. The internal cavity of the nozzle defines a secondary fluid passageway through the nozzle, terminating at the front end of the nozzle.

The first cylindrical wall member also includes at least one opening through the wall member at a first predetermined location. Preferably the opening through the wall member is located between the front end and the back end of the nozzle. The nozzle also includes a plurality of longitudinal grooves along the exterior surface of the first cylindrical wall member. The grooves extend from the front end toward the back end of the nozzle, preferably to a location between the opening through the wall member and the front end of the nozzle.

The showerhead further includes a ring valve which is defined by a second substantially cylindrical wall member. The ring valve also has a front end, a back end, a longitudinal axis which is substantially parallel with the longitudinal axis of the nozzle, and further has an interior surface which includes a recessed cavity. The ring valve fits over the nozzle in sliding engagement therewith. By its sliding action, the ring valve may be moved between a first position and a second position relative to the nozzle.

The first position of the ring valve is characterized by a relationship wherein the recessed cavity in the interior surface of the ring valve communicates with both the opening through the first cylindrical wall member of the nozzle and the grooves on the exterior surface of the nozzle. In this way, when the ring valve is in its first position relative to the nozzle, a primary fluid passageway is formed. That is, fluid from the secondary fluid passageway passes through the opening across the first cylindrical wall member, through the recessed cavity in the ring valve and the grooves in the exterior surface of the first cylindrical wall member and out the front end of the showerhead. The primary fluid passageway terminates in a plurality of small orifices at the front end of the nozzle defined by the plurality of grooves, producing a plurality of jet-stream sprays of fluid flowing through the primary passageway.

The second position of the ring valve in relation to the nozzle is characterized by a relationship wherein the recessed cavity on the interior surface of the second cylindrical wall member does not communicate with both the opening through and the groove on the exterior of the nozzle. As a result, the second cylindrical wall member prevents fluid communication between the opening and the grooves, thereby closing the primary fluid passageway, directing the fluid through the secondary passageway in the interior cavity of the showerhead, and producing an atomized stream-like mist of fluid flowing through the secondary passageway.

In a more preferred form, the nozzle of the improved showerhead includes two or more openings through the first cylindrical wall member, with both of the openings positioned in a plane transverse to the longitudinal axis of the nozzle. In this preferred embodiment, the plurality of grooves extend from the front end of the nozzle to a second plane transverse to the longitudinal axis of the nozzle. The second plane is spaced slightly apart from the first plane, preferably between the first plane and the front end of the nozzle.

The recessed cavity of the ring valve preferably comprises a substantially annular depression along the interior surface of the second cylindrical wall member. The recessed cavity lies in a third plane transverse to the longitudinal axis of the ring valve. The recessed cavity has a thickness or width along the direction of the longitudinal axis which is substantially equal to the distance between the first and second planes. In this way, the recessed cavity overlaps both the openings in the first plane and the grooves in the second plane when the ring valve is in its first position.

The first cylindrical wall member preferably includes a portion which is outwardly divergent frusto-conical near the front end of the nozzle. This outwardly divergent frusto-conical wall portion thus expands toward the second cylindrical wall member and constricts the orifices defined by the plurality of grooves at the front end of the nozzle. In this way, when the ring valve is in the first position relative to the nozzle, fluid flowing through the secondary fluid passageway will expand outward from the front end of the nozzle and create a venturi-type pressure drop adjacent thereby. This pressure drop assists in atomizing the water which flows through the secondary fluid passageway.

These and other objects and advantages of the present invention will become apparent from the following explanation of the preferred embodiment of our invention described in connection with the accompanying drawing.

Figure 1:
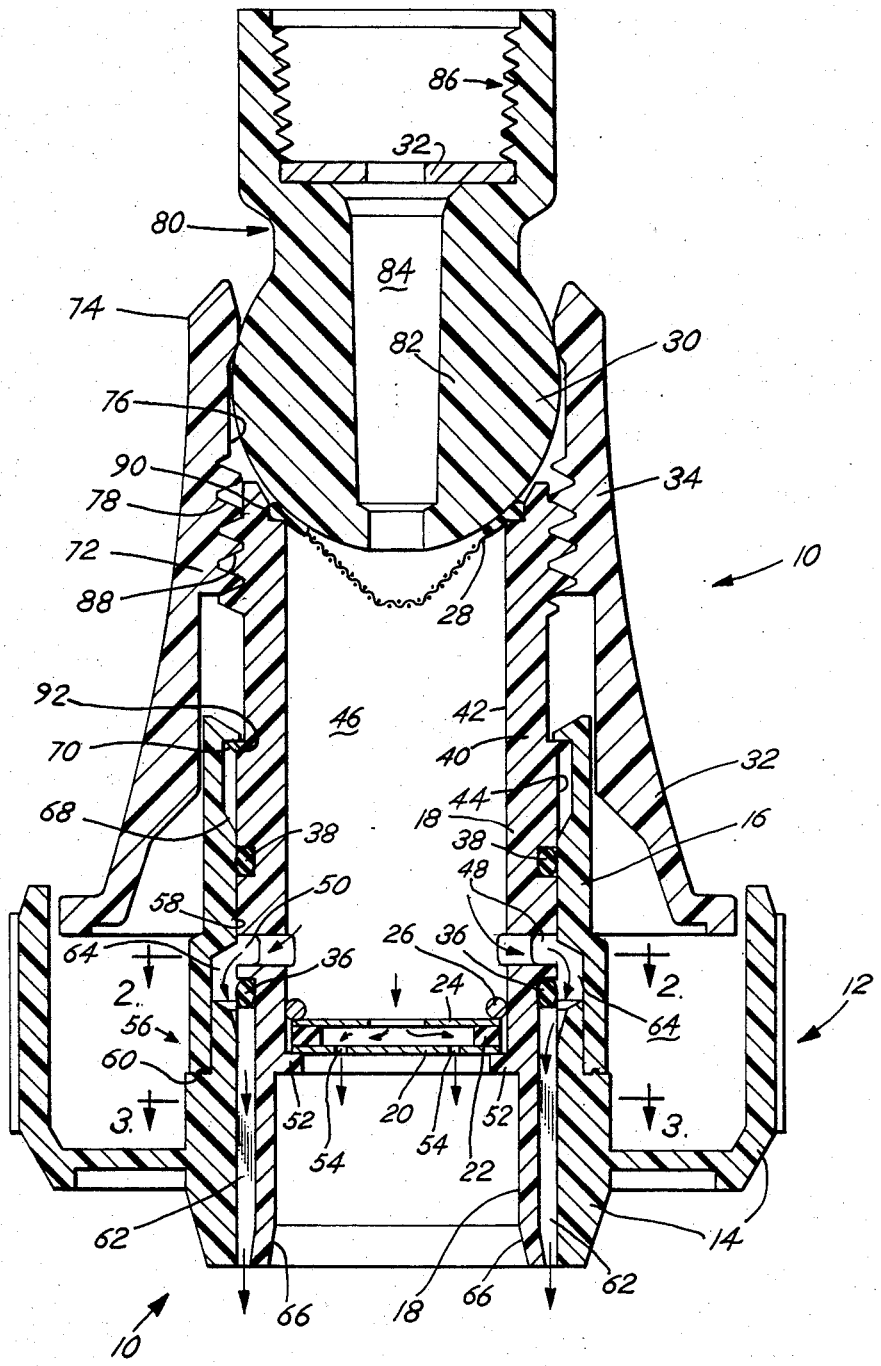
FIG. 1 is a horizontal cross sectional view showing one embodiment of the improved showerhead of the present invention.
Figure 2:
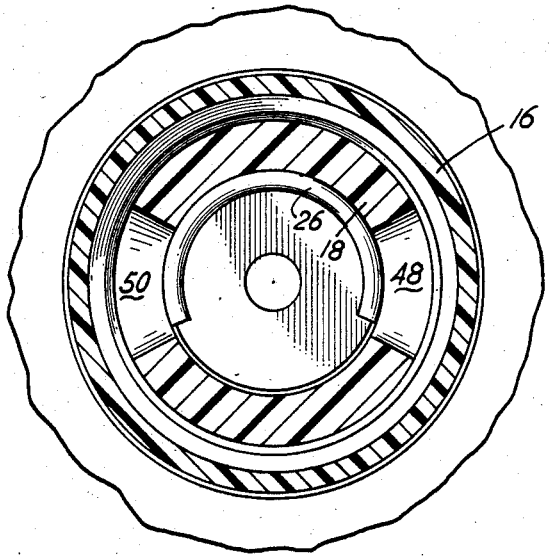
FIG. 2 shows a cross sectional view taken along line 2—2 of FIG. 1 looking toward the front end of the showerhead.
Figure 3:
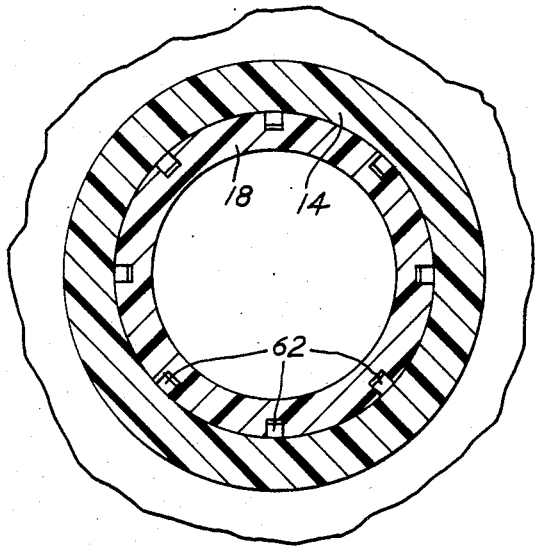
FIG. 3 shows a cross sectional view taken along line 3—3 of FIG. 1 looking toward the front end of the showerhead.

Throughout the various figures of the drawing, the same referenced numerals were used to designate the same parts of components of the showerhead. Moreover, when the terms "front", "rear", "front end", "rear end", "forward", and "rearward", are used herein, it is to be understood that these terms refer to the structures shown in the drawings as they would appear to a person viewing the drawing, and how such showerheads are normally used.

DETAILED DESCRIPTION OF THE PREFERRED EMBODIMENT

Referring now to FIGS. 1-5, a preferred embodiment of the improved showerhead of this invention is shown generally at 10. As best shown in FIG. 1, the showerhead 10 is adapted at its distal threaded end to be mounted on a conventional showerpipe that projects or extends from the wall in a bathroom shower or the like.

Figure 5:
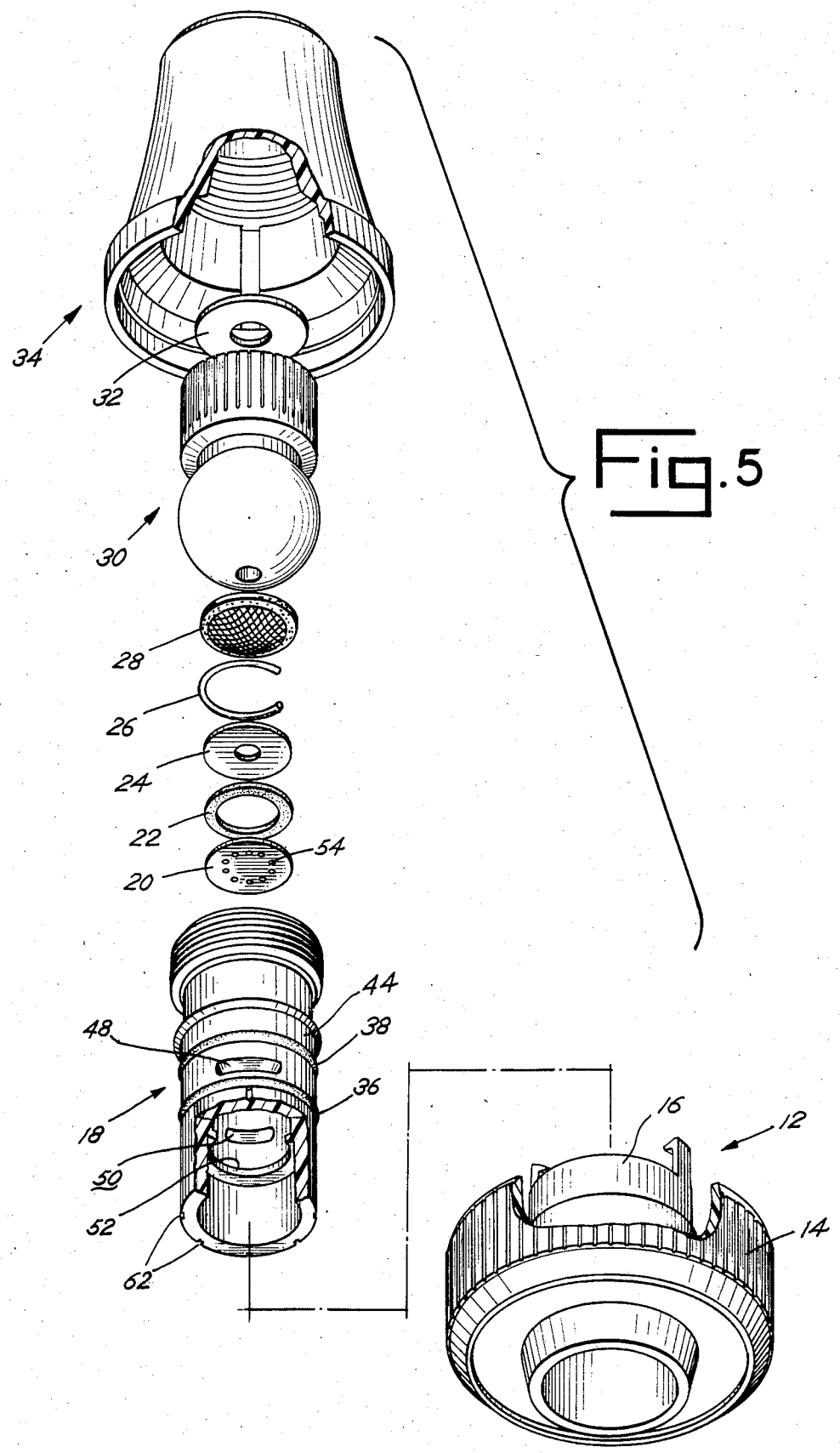
FIG. 5 is an exploded view showing the components of the showerhead of the present invention.

Referring to FIG. 5, the improved showerhead of this invention includes a ring valve 12 which consists of a valve handle 14 and a valve half 16. The improved showerhead 10 further includes a nozzle 18, a water deflector 20, a spacer 22, a flow restrictor 24, a metal ring spacer 26, a cone washer 28, a swivel ball 30, a flow control washer 32, and a cone attachment member 34. "O" rings 36 and 38 are mounted over the exterior surface of nozzle 18 to provide a water tight seal as will be described shortly.

Referring again to FIG. 1, the nozzle 18 comprises the first cylindrical wall member 40 which includes an interior surface 42 and an exterior surface 44. The interior surface 42 defines a substantially cylindrical passageway 46. This substantially cylindrical passageway 46 communicates with an external source of water and, near the front of the showerhead, defines the secondary fluid passageway through the showerhead 10.

The first cylindrical wall member 40 of the nozzle 18 includes preferably two openings 48 and 50 through the first cylindrical wall member 40. The openings 48, 50 preferably lie within a common plane transverse to the longitudinal axis of the showerhead 10.

The interior surface 42 of the first cylindrical wall member 40 preferably includes an annular projection 52 near the front end of the nozzle 18. This interior annular projection 52 is preferably located between the transverse plane and the front end of the nozzle 18. The interior annular projection 52 defines a ledge or "stop" for retaining the deflector 20, spacer 22, restricter 24, and metal ring members 26, 28.

As shown in FIG. 1, the deflector member 20 comprises a thin metal wafer with a plurality of small openings therethrough. The deflector 20 is positioned immediately adjacent the stop member 52. Spacer 22 is positioned adjacent the deflector 20, between the deflector 20 and the flow restrictor 24. As shown in FIG. 5, the flow restrictor 24 is a thin metal wafer with a single relatively large opening in the center thereof. Metal ring 26 fits adjacent to the flow restrictor 24, opposite the spacer 22, holding the deflector 20, spacer 22, and restrictor 24 in sandwich fashion adjacent the stop 52.

Water flowing through the secondary fluid passageway 46 impinges initially on flow restrictor 24 which allows only a relatively small stream of water through the center thereof. The stream of water through restrictor 24 thereafter impinges upon deflector 20 which creates substantial turbulence and forces the water to flow away from the center toward the periphery of the nozzle 18 and fluid passageway 46. The small openings 54 in the deflector 20 allow the agitated water to continue flowing through the secondary fluid passageway 46. The fluid is thereby sprayed out of the front end of the nozzle 18 in an atomized, steam-like mist.

As previously noted, the ring valve 12 comprises a valve handle 14 and valve half 16. As shown in FIG. 1, the valve handle 14 and valve half 16 comprise a second substantially cylindrical wall member, generally 56, having an interior surface 58 which fits adjacent the exterior surface 44 of the first cylindrical wall member 40. The second substantially cylindrical wall member 56 has a longitudinal axis which is concentric with the longitudinal axis of the nozzle 18. Moreover, the second cylindrical wall member 56 fits over the first cylindrical wall member 40 in sliding engagement therewith, such that the interior surface 58 of second cylindrical wall member 56 is adjacent to and slides along the exterior surface 44 of the first cylindrical wall member 40.

As shown most visibly in FIG. 1, the valve handle 14 and the valve half 16 are sonic welded at a butt joint 60 in order to form the ring valve 12. Although it may be possible to mold the ring valve 12 as a single integral element, we have found that the two-part element, butt welded at joint 60, provides a less expensive, but equally effective method of manufacture.

Referring now to FIG. 5, the front end of nozzle 18 includes a plurality of grooves 62 that preferably extend longitudinally toward the front end of the nozzle 18 from a predetermined location midway along the exterior surface 44 of the first cylindrical wall member 40. As shown even more clearly in FIG. 1, the second cylindrical wall member 56 fits over the first cylindrical wall member 40 and thereby encloses the grooves 62, such that they in essence define channels between the nozzle 18 and the ring valve 12 extending longitudinally toward the front end of the showerhead 10.

Referring to FIGS. 1 and 5, "o" rings 36, 38 are fitted around the nozzle 18 preferably between the first cylindrical member 40 and the second cylindrical wall member 56 and most preferably along either side of opening 18 to the first cylindrical wall member 40. More specifically, the openings 48 and 50 preferably lie in a common plane transverse to the longitudinal axis of the showerhead. The "o" rings 36 and 38 preferably lie in planes which are parallel to the plane of openings 48 and 50, but which are situated to the front and rear, respectively, of the plane. In this way, when the interior surface 58 of the second cylindrical wall member 56 in contact with both of the "o" rings 36 38, and a fluid tight seal is formed in a manner to be explained shortly.

The interior surface 58 of the second cylindrical wall member 56 is preferably formed with an annular cavity 64 around the inner periphery thereof. The annular cavity 64 has a predetermined width, the term "width" being understood to reference a distance extending parallel to the longitudinal axis of the showerhead 10. In preferred form, the annular cavity 64 is formed by fabricating the ring valve 14 and valve half 16 to dimensions which create a gap therebetween when those members are butt welded at weld 60 to define the interior surface 58.

As previously noted, ring valve 12 fits over the nozzle 18 in sliding engagement therewith along the longitudinal axis of the showerhead 10. More particularly, ring valve 12 slides between a first position and a second position in relation to the nozzle 18. The first position, shown in FIG. 1, is characterized by the creation of a primary fluid passageway cooperatively defined by opening 48, annular cavity 64, and groove or channels 62. It has been previously noted that the grooves or channels 62 extend longitudinally along the exterior surface 44 of the first cylindrical member wall member 40, but that the channels 62 stop short of the plane which transverses the longitudinal axis and includes the openings 48 and 50. When the ring valve 12 is in its first position in relation to the nozzle 18, the annular cavity 64 bridges over the openings 48, 50 and the channels 62 such that it communicates with each of them. Thus, fluid within the secondary fluid passageway 46 may flow out of the first cylindrical wall member 40 by way of openings 48 and 50, around the annular cavity 64 and into the grooves or channel 62. The pressure in the secondary fluid passageway thereby forces fluid to flow as the path of least resistance through the primary fluid passageway and out the plurality of small orifices at the front end of the showerhead 10 formed by channels 62 shown most clearly in FIG. 3.

The flow of fluid through the primary passageway creates an invigorating jet-like spray. However, a fraction of the water will also continue flowing through the secondary fluid passageway, continuing to create the steam-like mist to some degree.

Figure 4:
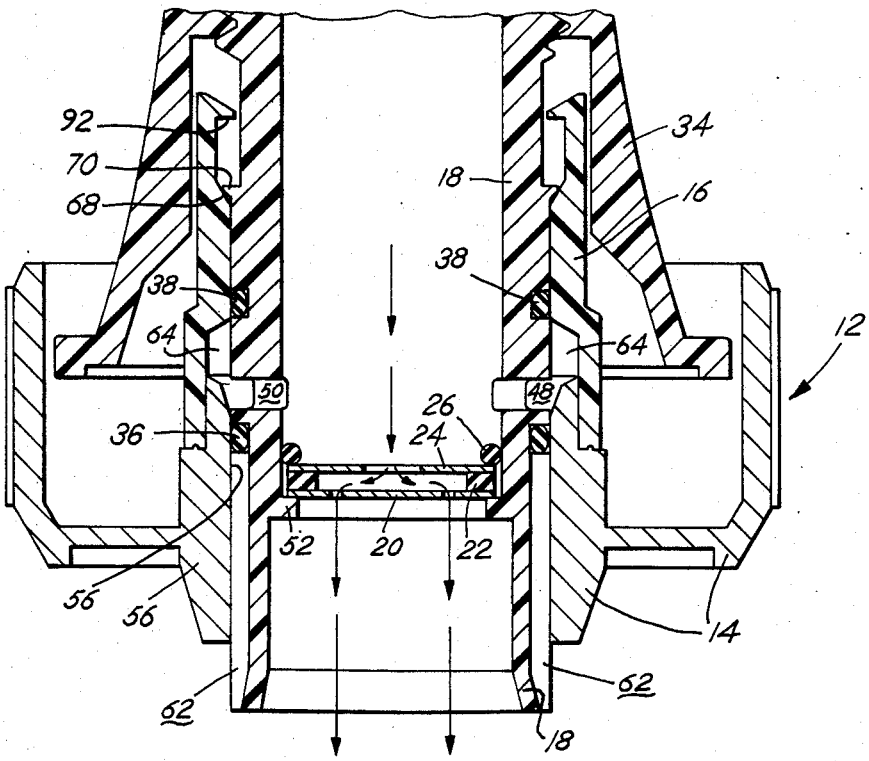
FIG. 4 shows a cross sectional view of the improved showerhead of FIG. 1 wherein the ring valve is in the second position relative to the nozzle.

The second position of the ring valve 12 in relation to nozzle 18, shown most clearly in FIG. 4, is reached by sliding the ring valve 12 backwards toward the rear of the showerhead 18 along the longitudinal axis of the showerhead 10. By this motion, the annular cavity 64 is moved away from communication with both the openings 48, 50 and the channel 62, thereby eliminating the communication between the openings 48, 50 and groove channel 62. In the second position of ring valve 12, the interior surface 58 of the second cylindrical wall member 56 abuts the "o" ring members 36 and 38 to form a seal and prevent the fluid communication to the primary fluid passageway. As a result, all of the fluid flow through the showerhead is directed through the secondary fluid passageway.

Referring again to FIG. 1, the portion of the first cylindrical wall member 40 near the front end of the showerhead 10 includes a frusto-conical outwardly diverging section 66. The frusto-conical outwardly diverging section 66 expands the fluid flowing through the secondary fluid passageway 46 as it reaches the front end of the showerhead 10. The expansion of the fluid creates a venturi-type pressure drop adjacent the front end of the showerhead 10. The pressure drop not only helps draw fluid through the secondary passageway, but also facilitates an atomization of the fluid flowing through the secondary fluid passageway. This atomization, created by venturi action, converts the fluid in the secondary fluid passageway into a steam-like mist.

The showerhead 10 of this invention also includes a nozzle locking mechanism for assuring the proper orientation of the ring valve 12 in either its first or second position relative to the nozzle 18. As shown in FIG. 1, the interior surface 58 of the second cylindrical wall member 56 includes a first ledge 92 and a second ledge 68, which are spaced apart from one another on the interior surface 58. In addition, the exterior surface 44 of the first cylindrical wall member 40 includes an annular projection or flange 70. In assembly of the showerhead 10, the ring valve 12 is slid over the nozzle 18 parallel to the longitudinal axis of the showerhead 10. By this sliding motion 10, the first ledge 92 passes over flange 70, such that the flange 70 snaps between the first flange 92 and the second flange 68. Thereafter, when the ring valve 12 is slidingly moved in relation to the nozzle 18, the flange 70 will come into contact with either the first ledge 92 or the second ledge 68, thereafter preventing further movement in a given direction.

As shown most clearly in FIG. 1, the first position of the ring valve 12 in relation to nozzle 18 is characterized by contact of the flange 70 with the first flange 92. As shown most clearly in FIG. 4, the second position of the ring valve 12 is characterized by sliding the ring valve 12 backwards in relation to the nozzle 18 until the flange 70 comes into contact with the second ledge 68. The distance between ledges 92 and 68 is selected so that the annular cavity 64 will communicate with both opening 48 and grooves 62 in the first position and so that the annular cavity 64 does not communicate with both opening 48 and grooves 62 in the second position.

The showerhead 10 includes an outer generally conical member 72 whose outer surface may include longitudinal "flutes" (not shown) or other esthetic designs to enhance attractiveness. The rear, smaller diameter end 74 of the member 72 includes an internal, annular recess 76 which is designed to receive a spherical member, as will be explained shortly. A threaded portion 78 is formed between the front end and the rear end of the member 72, immediately forward of the recess 76. The forward end of the member 72 is disposed adjacent to, but not in contact with, the valve handle 14.

A conventional ball swivel joint 80 is mounted in the rear end of the outer conical member 72 and includes a ball member 82 disposed in the annular recess 76 of the conical member 72. A longitudinal passage 84 extends through the joint 80 from one end to the other. The rear end of the joint 80 includes internal threads 86 which are adapted to cooperate with the threaded portion of a conventional shower arm pipe. The rear end of joint 80 thus connects the showerhead 10 with such pipe and with a source of water under pressure such as a conventional household water system.

The nozzle is disposed substantially within the outer conical member 72 and includes external threaded portions 88 formed about the rear end of the nozzle 18. An annular recess 90 is formed in the nozzle 18 adjacent to the rear end of the nozzle 18 and the external threads 88. The threaded portion 88 engages the internal threads 78 formed on the outer cone member 72. The threaded portions 78 and 88 are preferably designed so that there is an "interference" engagement between these threaded portions that prevents water from leaking therebetween.

The rear end of the conical member 72 abuts the ball member 82 of the swivel joint 80 and serves to restrain movement of the ball 80 with respect to the annular recess 90 in the outer cone member 72. In other words, the abutment between the rear end of the cone 72 and the ball member 82 serves to prevent relative movement between the swivel joint 80 and the rest of the showerhead 10. A conventional cone washer 28 is disposed within the recess 90 so as to prevent water from leaking between the rear end of the nozzle 18 and the ball member 82.

As shown in FIG. 1, the longitudinal passage 84 communicates with the primary fluid passageway 46. Thus, when water is permitted to flow through the household shower pipe (not shown), as when the faucet is opened, the water may also flow through the passage 84 in the swivel joint 80 and into and through the secondary fluid passageway 46 in the nozzle 18 and be atomized thereby into a steam-like mist. Depending upon whether the showerhead 10 is in its first or second position, the water may also flow through the primary fluid passageway.

In view of the foregoing, it should be apparent to those having ordinary skill in the art, that the showerhead 10 could be modified or changed without departing from the principles of our invention. For example, fewer or more grooves 62 could be employed and could have different configurations than shown. Thus, since the invention disclosed herein may be embodied in other specific forms without departing from the spirit or central characteristics thereof, the preferred embodiments described herein are to be considered in all respects as illustrative and not restrictive, the scope of the invention being indicated by the appended claims, rather than by the foregoing descriptions. All changes which come within the meaning and range of equivalency of the claims are therefore intended to be embraced therein.

What is claimed is:

1. An improved showerhead, comprising in combination:

a nozzle defined by a first substantially cylindrical wall member having a front end, a back end, a longitudinal axis, and an interior cavity, the back end of said nozzle adapted for connection to a water source, the interior cavity of said nozzle defining a secondary fluid passageway that terminates to define an orifice at the front end of the nozzle;

said nozzle including at least one opening through the first cylindrical wall member at a first predetermined location between the front end and the back end thereof, said nozzle further including a plurality of grooves on the exterior surface of the first cylindrical wall member terminating at the front end of the nozzle;

a ring valve defined by a second substantially cylindrical wall member having a front end, a back end, a longitudinal axis which is substantially parallel to the axis of the nozzle, and further having an interior surface with a recessed cavity therein and manually operated means for gripping and moving the ring valve, said ring valve fitting over and slidably supported by the nozzle for movement by the gripping means between a first position and a second position relative to the nozzle;

said recessed cavity of the ring valve being defined by a substantially annular depression in the interior surface of the second cylindrical wall member, said recessed cavity extending between and communicating with the opening through the first cylindrical wall member and said plurality of grooves to define a primary fluid passageway when the ring valve is in its first position, a plurality of spray streams of fluid flowing through the primary passageway;

said ring valve having sealing means to prevent communication between the recessed cavity of the ring valve and the plurality of grooves when the ring valve is in its second position, thereby directing all of the fluid to flow through the secondary fluid passageway in the interior cavity of the showerhead.

2. The improved showerhead claimed in claim 1 further comprising means for forming fluid spray mounted in the interior cavity of the nozzle at a location in the primary fluid passageway between the opening in the first cylindrical wall member and the front end of the nozzle.

3. The improved showerhead claimed in claim 1 wherein the first cylindrical wall member includes a wall portion which is outwardly divergent frusto-conical adjacent the front end of the nozzle, said outwardly divergent frusto-conical wall portion creating a pressure drop adjacent the front end of the nozzle when fluid flows through the secondary passageway to thereby assist in atomizing fluid flowing through the secondary passageway.

4. The improved showerhead of claim 1 wherein said exterior surface of said nozzle includes a projection thereon at a predetermined location between the opening in the first cylindrical wall member and the back end of the nozzle, and the interior surface of the ring valve includes first and second projecting surfaces near the back end of said ring valve, the ring valve being slidably mounted on the nozzle such that the projection on the nozzle is located between the first and second projections on the ring valve, the projection on the exterior surface of the nozzle contacts the first projection on the interior surface of the ring valve when the ring valve is in its first position, the projection on the exterior surface of the nozzle contacts the second projection on the interior surface of the ring valve when the ring valve is in its second position.

5. The improved showerhead of claim 1 wherein the movement of the ring valve between the first and second positions in relation to the nozzle is longitudinal and substantially in parallel to the axis of the nozzle and the ring valve.

6. The improved showerhead of claim 1 wherein the back end of the nozzle terminates in a section of threads, the showerhead further comprising an adjustable fluid connecting joint.

7. The improved showerhead of claim 6 wherein the adjustable fluid connecting joint further comprises a ball member and truncated cone member, the ball member having a rear section with threads, and a front section with enlarged spherical portion, the front and rear sections being connected by a narrow throat, said adjustable fluid connecting joint including an internal passageway extending through the front, rear and neck members, the truncated cone member having a front section which is larger and a rear section of reduced diameter which is smaller than the enlarged diameter of the ball member, said truncated cone member being fitted over the ball member such that the smaller section at the rear of the truncated cone member makes sealing contact with the enlarged diameter of the ball member of the threaded section of the truncated cone is adjoined to the threaded section of the nozzle.

8. The improved showerhead of claim 1 wherein said nozzle includes two or more openings through the first cylindrical wall member, said openings being positioned in a plane substantially transverse to the axis of the nozzle.

9. The improved showerhead of claim 1 wherein the sealing means includes an O-ring fitting over the nozzle for slidably sealing engagement with the interior surface of the second substantially cylindrical wall member.

10. The improved showerhead of claim 9 wherein the plurality of grooves extend from the front end of the nozzle to a first plane substantially transverse to the axis of the nozzle, the first plane being located between the opening through the first cylindrical wall member and the front end of the nozzle, and the O-ring being located between the opening through the first cylindrical wall member and the first plane.

11. An improved showerhead, comprising in combination:

a nozzle defined by a first substantially cylindrical wall member, said nozzle having a front end and a back end, said wall member having an interior surface and an exterior surface, the back end of said nozzle being adapted for connection to a water source, the interior surface of said wall member defining a secondary fluid passageway that communicates with said water source at the back end of said nozzle, and the first substantially cylindrical wall member defining an orifice at the front end of the nozzle;

said first substantially cylindrical wall member further including at least one opening at a predetermined location between the front end and back end of the nozzle, said opening defining a primary fluid passageway extending from the secondary fluid passageway across the first substantially cylindrical wall member.

said exterior surface side of said first cylindrical wall member including grooves that extend from the front end of the nozzle toward the back end of the nozzle;

a ring valve supported by the nozzle and defined by a second substantially cylindrical wall member having an inner surface that fits over the nozzle in contact with the first cylindrical wall member, said inner surface including a recess at a predetermined location, the ring valve and the grooves in the first cylindrical wall member cooperatively defining an enclosed passageway that extends from the back end of the nozzle along the exterior surface of the first cylindrical wall member, toward the front end of the nozzle and terminating in a plurality of orifices at the front end of the nozzle, the ring valve further having manually operated means for gripping and moving the ring valve;

said ring valve engaged in sliding contact with said nozzle between a first and second relation with said nozzle, said first relation being positioned by the manually operated gripping means such that the recess in the second cylindrical wall member communicates with both the grooves in the exterior surface of and the opening through the first cylindrical wall member, such that the primary fluid passageway extends across the first cylindrical wall member and through the enclosed passageway between the first and second cylindrical wall member to said plurality of orifices;

the second relation of the ring valve with the nozzle being positioned by the manually operated gripping means such that the second cylindrical wall member blocks fluid communication between the opening through and the grooves on the first cylindrical wall member, thereby preventing fluid from flowing through the primary fluid passageway and, instead directing all of the fluid to flow through the secondary fluid passageway.

* * * * *